US008833254B2

(12) United States Patent
Veres et al.

(10) Patent No.: US 8,833,254 B2
(45) Date of Patent: Sep. 16, 2014

(54) IMAGING SYSTEM WITH ELECTROPHOTOGRAPHIC PATTERNING OF AN IMAGE DEFINITION MATERIAL AND METHODS THEREFOR

(75) Inventors: Janos Veres, San Jose, CA (US); David K. Biegelsen, Portola Valley, CA (US); Chu-heng Liu, Penfield, NY (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 126 days.

(21) Appl. No.: 13/548,127

(22) Filed: Jul. 12, 2012

(65) Prior Publication Data

US 2014/0013972 A1 Jan. 16, 2014

(51) Int. Cl.

| | |
|---|---|
| ***B41F 16/00*** | (2006.01) |
| ***G03G 5/00*** | (2006.01) |
| ***G03G 15/10*** | (2006.01) |

(52) U.S. Cl.

USPC ..... 101/142; 101/141; 101/451; 101/452; 399/237; 399/240

(58) Field of Classification Search

USPC ..... 101/141, 142, 451, 452; 399/133, 154, 399/237, 238, 239, 240

See application file for complete search history.

(56) References Cited

U.S. PATENT DOCUMENTS

| | | | | |
|---|---|---|---|---|
| 3,285,741 | A | 11/1966 | Gesierich | |
| 3,741,118 | A | 6/1973 | Carley | |
| 3,800,699 | A | 4/1974 | Carley | |
| 3,877,372 | A | 4/1975 | Leeds | |
| 4,627,349 | A | 12/1986 | Claussen | |
| 4,887,528 | A | 12/1989 | Ruge | |
| 5,067,404 | A | 11/1991 | Frunder et al. | |
| 5,701,815 | A | 12/1997 | Bocko | |
| 5,826,147 | A * | 10/1998 | Liu et al. | 399/237 |

(Continued)

FOREIGN PATENT DOCUMENTS

| | | |
|---|---|---|
| DE | 101 60 734 A1 | 7/2002 |
| DE | 103 60 108 A1 | 7/2004 |

(Continued)

OTHER PUBLICATIONS

Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).

(Continued)

*Primary Examiner* — Daniel J Colilla
*Assistant Examiner* — Blake A Tankersley
(74) *Attorney, Agent, or Firm* — Ronald E. Prass, Jr.; Prass LLP

(57) ABSTRACT

A system comprises an electrophotographic subsystem, a transfer subsystem, an imaging member, and an inking subsystem. The electrophotographic subsystem comprises a photoreceptor, a charging subsystem, an exposure subsystem, and a development subsystem. In operation, the photoreceptor is charged areawise. An exposure pattern is formed by the exposure subsystem on the surface of the charged photoreceptor to thereby write a latent charge image onto the photoreceptor surface. The image is developed with an image defining material, such as a dampening fluid. The image defining material forms a negative pattern of the image to be printed. This negative image is then transferred to the reimageable surface. The negative image is then developed with ink. The inked image may be transferred to a substrate.

3 Claims, 12 Drawing Sheets

(56) References Cited

U.S. PATENT DOCUMENTS

| | | | |
|---|---|---|---|
| 5,855,173 | A | 1/1999 | Chatterjee et al. |
| 6,125,756 | A | 10/2000 | Nussel et al. |
| 6,146,798 | A | 11/2000 | Bringans et al. |
| 6,318,264 | B1 | 11/2001 | D'Heureuse et al. |
| 6,561,090 | B1 | 5/2003 | Spooner |
| 6,725,777 | B2 | 4/2004 | Katano |
| 6,841,366 | B1 | 1/2005 | Bower et al. |
| 6,901,853 | B2 | 6/2005 | Baldy et al. |
| 7,020,355 | B2 | 3/2006 | Lahann et al. |
| 7,061,513 | B2 | 6/2006 | Katano et al. |
| 7,100,503 | B2 | 9/2006 | Wiedemer et al. |
| 7,191,705 | B2 | 3/2007 | Berg et al. |
| 2003/0167950 | A1 | 9/2003 | Mori |
| 2004/0011234 | A1 | 1/2004 | Figov |
| 2005/0178281 | A1 | 8/2005 | Berg et al. |
| 2005/0258136 | A1 | 11/2005 | Kawanishi |
| 2006/0152566 | A1 | 7/2006 | Taniuchi |
| 2007/0199457 | A1 | 8/2007 | Cyman, Jr. et al. |
| 2007/0199458 | A1 | 8/2007 | Cyman, Jr. et al. |
| 2007/0199459 | A1 | 8/2007 | Cyman, Jr. et al. |
| 2007/0199460 | A1 | 8/2007 | Cyman, Jr. et al. |
| 2007/0199461 | A1 | 8/2007 | Cyman, Jr. et al. |
| 2007/0199462 | A1 | 8/2007 | Cyman, Jr. et al. |
| 2008/0011177 | A1 | 1/2008 | Muraoka |
| 2008/0032072 | A1 | 2/2008 | Taniuchi |
| 2008/0223240 | A1 | 9/2008 | Drury |
| 2010/0031838 | A1 | 2/2010 | Lewis et al. |

FOREIGN PATENT DOCUMENTS

| | | | | |
|---|---|---|---|---|
| DE | 10 2006 050744 | A1 | 4/2008 | |
| DE | 10 2008 062741 | | 7/2010 | |
| EP | 1 935 640 | A2 | 6/2008 | |
| EP | 1 938 987 | A2 | 7/2008 | |
| EP | 1 964 678 | A2 | 9/2008 | |
| JP | H0298482 | * | 4/1990 | ..... B41M 5/00 |
| WO | 2006/133024 | | 12/2006 | |
| WO | WO 2009025821 | A1 | 2/2009 | |

OTHER PUBLICATIONS

Katano et al., "The New Printing System Using the Materials of Reversible Change of Wettability", International Congress of Imaging Science 2002, Tokyo, pp. 297 et seq. (2002).
U.S. Appl. No. 13/095,714, filed Apr. 27, 2011, Stowe et al.
U.S. Appl. No. 13/095,737, filed Apr. 27, 2011, Stowe et al.
U.S. Appl. No. 13/095,745, filed Apr. 27, 2011, Stowe et al.
U.S. Appl. No. 13/095,757, filed Apr. 27, 2011, Stowe et al.
U.S. Appl. No. 13/095,764, filed Apr. 27, 2011, Stowe et al.
U.S. Appl. No. 13/095,773, filed Apr. 27, 2011, Stowe et al.
U.S. Appl. No. 13/095,778, filed Apr. 27, 2011, Stowe et al.
U.S. Appl. No. 13/204,515, field Aug. 5, 2011, Stowe et al.
U.S. Appl. No. 13/204,526, filed Aug. 5, 2011, Stowe et al.
U.S. Appl. No. 13/204,548, filed Aug. 5, 2011, Stowe et al.
U.S. Appl. No. 13/204,560, filed Aug. 5, 2011, Pattekar et al.
U.S. Appl. No. 13/204,567, field Aug. 5, 2011, Stowe et al.
U.S. Appl. No. 13/204,578, filed Aug. 5, 2011, Stowe et al.
U.S. Appl. No. 13/366,947, field Feb. 6, 2012, Biegelsen.
U.S. Appl. No. 13/426,209, filed Mar. 21, 2012, Liu et al.
U.S. Appl. No. 13/426,262, filed Mar. 21, 2012, Liu et al.
U.S. Appl. No. 13/548,134, filed Jul. 12, 2012, Veres et al.
U.S. Appl. No. 13/548,146, filed Jul. 12, 2012, Veres et al.
U.S. Appl. No. 13/548,151, field Jul. 12, 2012, Veres et al.
U.S. Appl. No. 13/548,155, filed Jul. 12, 2012, Veres et al.
U.S. Appl. No. 13/548,157, filed Jul. 12, 2012, Veres et al.

* cited by examiner

IMAGING SYSTEM WITH ELECTROPHOTOGRAPHIC PATTERNING OF AN IMAGE DEFINITION MATERIAL AND METHODS THEREFOR

BACKGROUND

The present disclosure is related to marking and printing methods and systems, and more specifically to methods and systems for variably marking or printing data using lithographic and electrophotographic systems and methods.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution (typically consisting of water and a small amount of alcohol as well as other additives and/or surfactants to reduce surface tension). The hydrophobic regions repel fountain solution and accept ink, whereas the fountain solution formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Also, the surface roughness of the offset blanket cylinder helps to deliver a more uniform layer of printing material to the substrate free of defects such as mottle. Sufficient pressure is used to transfer the image from the offset cylinder to the substrate. Pinching the substrate between the offset cylinder and an impression cylinder provides this pressure.

In one variation, referred to as dry or waterless lithography or driography, the plate cylinder is coated with a silicone rubber that is oleophobic and physically patterned to form the negative of the printed image. A printing material is applied directly to the plate cylinder, without first applying any fountain solution as in the case of the conventional or "wet" lithography process described earlier. The printing material includes ink that may or may not have some volatile solvent additives. The ink is preferentially deposited on the imaging regions to form a latent image. If solvent additives are used in the ink formulation, they preferentially diffuse towards the surface of the silicone rubber, thus forming a release layer that rejects the printing material. The low surface energy of the silicone rubber adds to the rejection of the printing material. The latent image may again be transferred to a substrate, or to an offset cylinder and thereafter to a substrate, as described above.

The above-described lithographic and offset printing techniques utilize plates which are permanently patterned, and are therefore useful only when printing a large number of copies of the same image (long print runs), such as magazines, newspapers, and the like. Furthermore, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Lithography and the so-called waterless process provide very high quality printing, in part due to the quality and color gamut of the inks used. Furthermore, these inks—which typically have a very high color pigment content (typically in the range of 20-70% by weight)—are very low cost compared to toners and many other types of marking materials. Thus, while there is a desire to use the lithographic and offset inks for printing in order to take advantage of the high quality and low cost, there is also a desire to print variable data from page to page. Heretofore, there have been a number of hurdles to providing variable data printing using these inks. Furthermore, there is a desire to reduce the cost per copy for shorter print runs of the same image.

One problem encountered is that offset inks have too high a viscosity (often well above 50,000 cps) to be useful in nozzle-based inkjet systems. In addition, because of their tacky nature, offset inks have very high surface adhesion forces relative to electrostatic forces and are therefore difficult to manipulate onto or off of a surface using electrostatics. (This is in contrast to dry or liquid toner particles used in electrographic systems, which have low surface adhesion forces due to their particle shape and the use of tailored surface chemistry and special surface additives.)

Efforts have been made to create lithographic and offset printing systems for variable data in the past. One example is disclosed in U.S. Pat. No. 3,800,699, incorporated herein by reference, in which an intense energy source such as a laser to pattern-wise evaporate a fountain solution.

In another example disclosed in U.S. Pat. No. 7,191,705, incorporated herein by reference, a hydrophilic coating is applied to an imaging belt. A laser selectively heats and evaporates or decomposes regions of the hydrophilic coating. Next a water based fountain solution is applied to these hydrophilic regions rendering them oleophobic. Ink is then applied and selectively transfers onto the plate only in the areas not covered by fountain solution, creating an inked pattern that can be transferred to a substrate. Once transferred, the belt is cleaned, a new hydrophilic coating and fountain solution are deposited, and the patterning, inking, and printing steps are repeated, for example for printing the next batch of images.

In yet another example, a rewritable surface is utilized that can switch from hydrophilic to hydrophobic states with the application of thermal, electrical, or optical energy. Examples of these surfaces include so called switchable polymers and metal oxides such as $ZnO_2$ and $TiO_2$. After changing the surface state, fountain solution selectively wets the hydrophilic areas of the programmable surface and therefore rejects the application of ink to these areas.

High-speed inkjet printing is another approach currently utilized for variable content printing. Special low-viscosity inks are used in these processes to permit rapid volume printing that can produce variable content up to page-by-page content variation. High-speed electrophotographic processes are also known.

However, there remain a number of problems associated with these techniques. For example, the process of selective evaporation of dampening fluid requires a relatively high-powered, coherent radiation source, which generates heat and consume undesirably large amount of power. Such high-powered radiation sources are also quite expensive.

High-speed inkjet systems and process rely on special low viscosity inks that produce a non-standard final printed product. Such inks are also limited in the color ranges available. Further, such inks are relatively quite costly.

High-speed electrophotographic systems and process require "liquid toners" (electrophotography typically being a dry process). These liquid toners are essentially charged toner particles suspended in an insulating liquid. Producing an appropriate liquid toner that appropriately balances color, ability to charge, cleanability, and low cost has proven difficult.

Switchable coatings, especially the switchable polymers discussed above, are typically prone to wear and abrasion and expensive to coat onto a surface. Another issue is that they typically do not transform between hydrophobic and hydrophilic states in the fast (e.g., sub-millisecond) switching timescales required to enable high-speed variable data printing. Therefore, their use would be mainly limited to short-run print batches rather than to truly variable data high speed digital lithography wherein every impression can have a different image pattern, changing from one print to the next.

SUMMARY

Accordingly, the present disclosure addresses the above problems, as well as others, enabling the printing of variable content without complex toners and supporting systems. The present disclosure is directed to systems and methods for providing hybrid electrophotography and lithography.

A system according to one embodiment of the present disclosure comprises an electrophotographic subsystem, a transfer subsystem, an imaging member, and an inking subsystem. The electrophotographic subsystem comprises a photoreceptor, a charging subsystem, an exposure subsystem, and in numerous embodiments a development subsystem. The imaging member comprises a reimageable surface having certain properties, such as having a low surface energy to promote ink release onto a substrate.

In operation, the photoreceptor is charged areawise. A light beam from the exposure subsystem is then scanned and pulsed onto the surface of the charged photoreceptor to thereby write a latent charge image on the photoreceptor surface.

In certain embodiments, the latent charge image is developed with an image defining material, comprising liquid or dry toner that is itself charged (or contains charged particles) in such a manner as to be attracted to the latent charge regions on the photoreceptor surface. In the case of a liquid, the material may function as a dampening fluid that rejects ink in subsequent steps. For this reason, we interchangeably refer to liquid toner and dampening fluid herein. In the case of a dry toner, the material may form an ink-phobic pattern that also rejects ink applied in subsequent steps. It will be appreciated that while we refer to a material as toner in the present disclosure, this reference is for convenience and clarity, and non-toner or toner-like materials that provide the same or similar functionality are within the scope of the present disclosure. The toner particles preferably have no pigmentation. For liquid toner the particles are designed to entrain as much liquid as possible.

A negative pattern of the image to be printed is therefore formed of the image defining medium on the photoreceptor surface. This negative image is then transferred to the reimageable surface. In one embodiment, the image defining medium is a dampening fluid.

The negative image is then developed with an ink having desirable properties such as having an appropriate color, providing a desirable final surface quality, having a low cost, being environmentally benign, and so on. Ink is not transferred to the reimageable surface in the regions where the dampening fluid resides. In those regions the dampening fluid splits and the ink stays with the inking roller. The inked image is then transferred to a substrate at a nip roller or the like. Post printing, much of the split dampening fluid will be evaporated from the reimageable surface or transferred to the substrate where it will quickly evaporate, leaving the inked image. An optional cleaning subsystem will remove any residual dampening fluid and ink, readying the imaging member for a next printing pass.

Alternatively, the negative image may be developed with ink on the photoreceptor surface. The ink with or without the toner material may be transferred to a reimageable surface prior to applying the ink image to a substrate.

According to another embodiment, the image defining medium is a dry toner. Again, the negative of the image to be printed may be formed and transferred to the reimageable surface, where it is inked.

According to another embodiment, the reimageable surface is wetted uniformly with dampening fluid before encountering the photoreceptor. The charge pattern on the photoreceptor attracts regions of the dampening solution and removes them from the reimageable surface ("erases" those regions.) The remaining image defining medium is a negative latent image for inking the reimageable surface.

The above is a summary of a number of the unique aspects, features, advantages, and embodiments of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details are merely summarized or are omitted so as not to unnecessarily obscure the details of the present disclosure. Thus, where details are otherwise well known, we leave it to the application of the present disclosure to suggest or dictate choices relating to those details.

Figure 1:
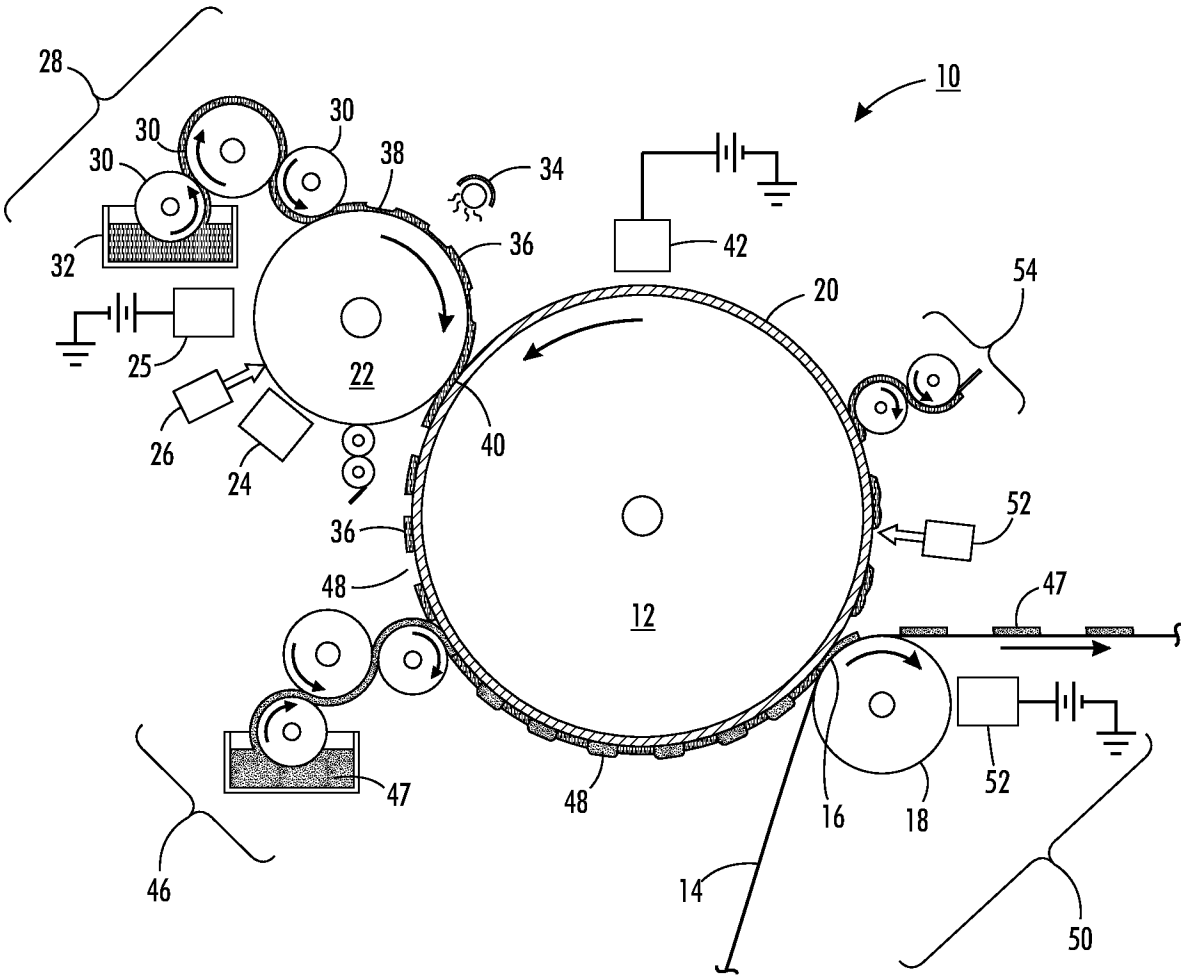
FIG. 1 is a side view of a system for variable lithography according to an embodiment of the present disclosure.

With reference to FIG. 1, there is shown therein a system 10 for electrophotographic patterning of a dampening fluid according to one embodiment of the present disclosure. System 10 comprises an imaging member 12, in this embodiment a drum, but may equivalently be a plate, belt, etc., surrounded by a number of subsystems described in detail below. Imaging member 12 applies an ink image to substrate 14 at nip 16 where substrate 14 is pinched between imaging member 12 and an impression roller 18. A wide variety of types of substrates, such as paper, plastic or composite sheet film, ceramic, glass, etc. may be employed. For clarity and brevity of this explanation we assume the substrate is paper, with the understanding that the present disclosure is not limited to that form of substrate. For example, other substrates may include cardboard, corrugated packaging materials, wood, ceramic tiles, fabrics (e.g., clothing, drapery, garments and the like), transparency or plastic film, metal foils, etc. A wide latitude of marking materials may be used including those with pigment densities greater than 10% by weight including but not limited to metallic inks or white inks useful for packaging. For clarity and brevity of this portion of the disclosure we generally use the term ink, which will be understood to include the range of marking materials such as inks, pigments, and other materials, which may be applied by systems and methods, disclosed herein.

In one embodiment, imaging member 12 comprises a thin reimageable surface layer 20 formed over a structural mounting layer (for example metal, ceramic, plastic, etc.), which together forms a rewriteable printing blanket. Additional structural layers, such as an intermediate layer (not shown) below reimageable surface layer 20 may be electrically insulating (or conducting), thermally insulating (or conducting), have variable compressibility and durometer, and so forth. In one embodiment, an intermediate layer is composed of closed cell polymer foam sheets and woven mesh layers (for example, cotton) laminated together with very thin layers of adhesive. Typically, blankets are optimized in terms of compressibility and durometer using a 3-4 ply layer system that is between 1-3 mm thick with reimageable surface layer 20 designed to have optimized texture, toughness, and surface energy properties.

Reimageable surface layer 20 may take the form of a standalone drum or web, or a flat blanket wrapped around a cylinder core. In another embodiment the reimageable surface layer 20 is a continuous elastic sleeve placed over a cylinder core. Flat plate, belt, and web arrangements (which may or may not be supported by an underlying drum configuration) are also within the scope of the present disclosure. For the purposes of the following discussion, it will be assumed that reimageable surface layer 20 is carried by a cylinder core, although it will be understood that many different arrangements, as discussed above, are contemplated by the present disclosure.

Reimageable surface layer 20 should have a weak adhesion force to the ink at the interface, yet sufficiently good wetting properties with the ink, to promote uniform (free of pinholes, beads or other defects) inking of the reimageable surface and to promote the subsequent forward transfer lift-off of the ink onto the substrate. (Here the presence of oil incorporated into the plate may also aid subsequent transfer.) Silicone is one material having this property. Other materials providing this property may alternatively be employed, such as certain blends of polyurethanes, fluorocarbons, etc. In terms of providing adequate wetting of dampening fluid, the silicone surface need not be attractive to the fluid because wetting surfactants, such as silicone glycol copolymers, may be added to the dampening fluid to allow the dampening fluid to wet the silicone surface.

A photo-responsive photoreceptor 22 is charged by an appropriate mechanism 24, such as a corona discharge device, to have a first charge polarity. Charged photoreceptor 22 is then exposed, such as by light from a laser or LED array source 26. In the case of a laser, source 26 is both pulsed, such as by a controller (not shown) and scanned, such as by a raster output scanner (ROS) subsystem (not shown). In the case of an LED array or light bar, the individual elements comprising the array are modulated to produce the desired exposure pattern line-by-line. By way of exposure, the scanned and pulse beam or pulsed linear array creates a latent charge image on the surface of photoreceptor 22.

It is understood that for the purposes of this disclosure, the term "light" is used to refer to wavelengths of electromagnetic radiation for exposure of photoreceptor 22. As used herein, "light" may be any of a wide range of wavelengths from the electromagnetic spectrum, whether normally visible to the unaided human eye (visible light), ultraviolet (UV) wavelengths, infrared (IR) wavelengths, micro-wave wavelengths, and so on.

An image defining material in the form of a dampening fluid is then applied to the latent image on the surface of photoreceptor 22 by a dampening fluid subsystem 28. Dampening fluid subsystem 28 generally comprises a series of rollers 30 (referred to as a dampening unit) for uniformly wetting the surface of photoreceptor 22 with a dampening fluid 31 from reservoir 32. It is well known that many different types and configurations of dampening units exist. For example, spray systems, condensation systems, extrusion systems, and so on may alternatively be employed. The purpose of the dampening unit is to deliver a controlled thickness of dampening fluid 31 on regions of photoreceptor 22 defined by the latent charge image over unexposed (charged) regions of the photoreceptor. As will be explained further below, the dampening fluid may comprise a liquid toner. Therefore, liquid toner delivery subsystems may also be employed as the dampening fluid subsystem 28.

The dampening fluid applied by dampening fluid subsystem 28 essentially takes the place of toner in a typical electrophotographic process. According to one embodiment, the dampening fluid has certain properties rendering it both an effective electrophotographic printing material and a lithographic dampening fluid. The dampening fluid may comprise a carrier fluid that includes a toner-like chargeable material, such as organic/inorganic compact particles or dendritically shaped brushes, polymers or aggregates. For reasons explained further below, the particles ideally also have a surface quality and composition such that they provide a high degree of liquid drag within the carrier fluid. Many materials are suitable as long as the material can carry electrostatic charge. In one embodiment, polymer aggregate further comprises charge control agents. The polymer material may be partially cross-linked to provide a plurality of aggregates.

The particles may be dispersed in a carrier fluid. In one embodiment, the carrier fluid is insulative. Examples include (but are not limited to) oils, or fluorosolvents such as Isopar (synthetic isoparaffin, Exxon Mobil), Flourinert (FC40 electronic fluid, 3M Corp.), Novec (engineered fluid, 3M Corp.), and the like. It is also useful, again for reasons discussed further below, that carrier fluid be relatively cohesive. Materials used as an ink vehicle in liquid electrophotography may be considered. The carrier fluid with particles may be formulated as a low solid content, colorless liquid "toner".

According to one embodiment of the present disclosure, the particles in the dampening fluid are provided with a second charge (i.e., of a second charge polarity). This charge is of opposite sign (polarity) to the charge applied to the photoreceptor 22. The particles may be charged as a step in the process of forming the dampening fluid, e.g. triboelectrically or by zeta potential formation, or may be charged in situ prior to application such as by a charging device 25.

Areas of photoreceptor 22 that are not exposed by light source 26 remain charged, and the particles in the dampening fluid are selectively attracted thereto. Thus, as a second consequence the particles are more strongly attracted to the photoreceptor in these regions. The particles migrate toward the charged region of photoreceptor 22, dragging carrier fluid with them. As the photoreceptor leaves the nip with roller 30, carrier fluid splits providing a net fluid thickness on the photoreceptor surface greater than the thickness of adhering toner particles. Over regions of the photoreceptor that have been exposed by light source 26 (discharged regions), dampening fluid will be repelled by the nature of the photoreceptor surface (e.g., high interface energy between the photoreceptor surface and the dampening fluid), leaving those regions over the surface of photoreceptor 22 without dampening fluid. In certain cases, motion of the particles may also carry fluid away from regions that have been exposed by light source 26. This causes a splitting of the dampening fluid at the delivery roller 30, with fluid preferentially transferring to the photoreceptor over charged regions, and remaining on the delivery roller over uncharged regions. (The splitting may not be complete, but will be sufficient to provide image pattern formation, as discussed further below.)

Figure 2A:
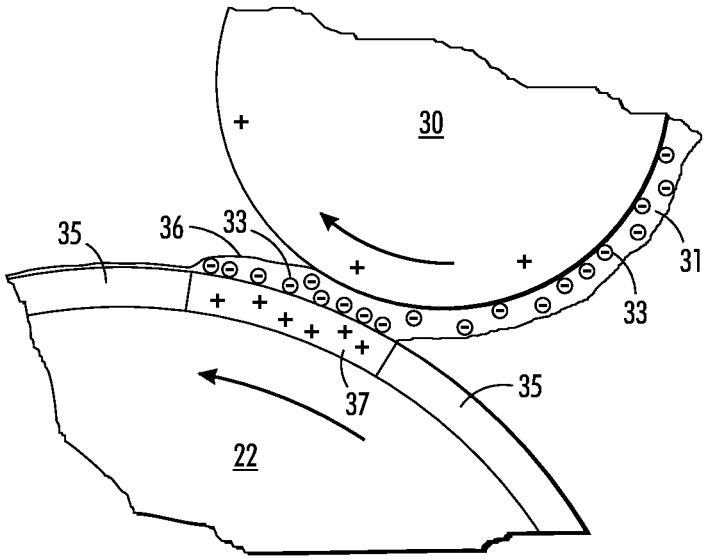
FIGS. 2A and 2B are side-view, cut-away illustrations of a mechanism for selectively applying dampening fluid to a surface of a photoreceptor according to one embodiment of the present disclosure.
Figure 2B:
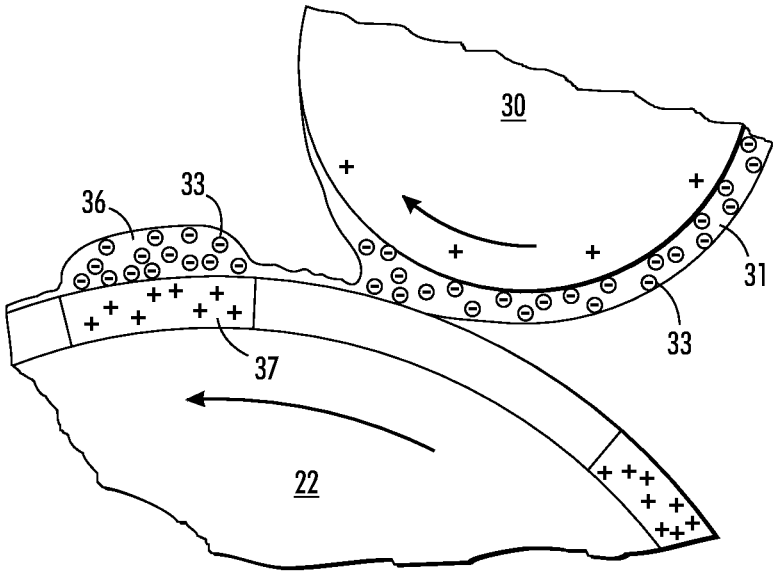

The process of developing the dampening fluid on the surface of photoreceptor 22 is illustrated in the example shown in FIGS. 2A and 2B. With reference to FIG. 2A, a region 35 of photoreceptor 22 has been exposed to light, thereby discharging that region. An adjacent region 37 has not been exposed, and therefore retains the initial charge applied to the photoreceptor. As dampening fluid 31 is brought proximate the surface of photoreceptor 22, particles 33 (or ionic species) are attracted to photoreceptor 22 in regions 37. The particles carry with them excess carrier fluid, thereby creating a dampening fluid region 36.

With reference to FIG. 2B, in regions over exposed portions of photoreceptor 22, where charge has been dissipated, dampening fluid 31 will be less attracted to photoreceptor 22, and will remain on roller 30. Roller 30 may be provided with a surface charge density (e.g., repulsive to the charge in region 37) to assist with this preferential transfer mechanism. In addition or as an alternative, the composition of the surface of photoreceptor 22 may be further selected to repel dampening fluid 31 absent any electrostatic attraction, to thereby improve the selectivity of this mechanism for forming regions 36.

While the previous example is based on exposure of a region of the photoreceptor discharging that region (i.e., that region having a first charge state), and remaining unexposed regions retaining an applied charge (i.e., remaining regions having a second charge state), in other embodiments the states may be reversed. For example, a discharge device (not shown) may discharge regions of the photoreceptor not exposed by the exposure subsystem, with exposed regions retaining the applied charge. Another mechanism may operate to retain a charge of a first polarity (i.e., a first charge state) in unexposed regions, while converting charge to an opposite polarity (i.e., a second charge state) in exposed regions, or vice-versa. Many other mechanisms are possible for selecting a charge state as a function of exposure or lack of exposure of the photoreceptor surface. Thus, these variations are contemplated by the present disclosure.

One mechanism for electrostatically enhanced dampening fluid retention has been described above. However, many different mechanisms are possible, and the precise mechanism by which dampening fluid attaches to or is rejected by the photoreceptor does not form a limitation of the claims unless otherwise recited in those claims.

Returning to FIG. 1, the result of the aforementioned process is that numerous regions 36 are provided on the surface of photoreceptor 22, separated by regions 38 that are generally absent of dampening fluid. However, in certain embodiments, some residual dampening fluid may remain in regions 38 over unexposed regions of photoreceptor 22. This residual dampening fluid will form a relatively much thinner region (in cross-section) as compared with adjacent fluid regions remaining over exposed regions of photoreceptor 22. For example, in one embodiment regions 36 are on the order of 0.2 μm to 1.0 μm thick (and very uniform without pin holes), while residual dampening fluid regions 38 may be on the order of less than 0.1 μm. Thinner liquid regions require more force to split and therefore the adhesion to the reimageable surface 20 can be insufficient to transfer residual dampening fluid regions 38, yet strong enough to split regions 36. Provided that there is a contrast between the amount of the fluid present over exposed and non-exposed areas of the photoreceptor, a latent liquid image can nonetheless be formed which manifests in more or less fluid on the photoreceptor. Areas where a thinner layer of fluid is present can be evaporated or dried if desired by areawise heating by heating element 34. The latent negative image on photoreceptor 22 may then be transferred to reimageable surface 20 at transfer point 40.

As the relative motions of photoreceptor 22 and imaging member 12 proceed, dampening fluid regions 36 are transferred from the surface of photoreceptor 22 to reimageable surface 20. In one mechanism, the dampening fluid wets the reimageable surface, and due to the nature of reimageable surface 20 a portion of the dampening fluid transfers thereto. While some fluid may remain on photoreceptor 22 after transfer of the majority thereof to reimageable surface 20, and indeed some fluid in regions 38 may also be transferred, the relative volume and hence height above reimageable surface 20 of the transferred regions 38 will be sufficient to retain adequate contrast between the amount of the fluid in regions 36 and in regions 38 such that a liquid image is formed on reimageable surface 20.

Figure 3:
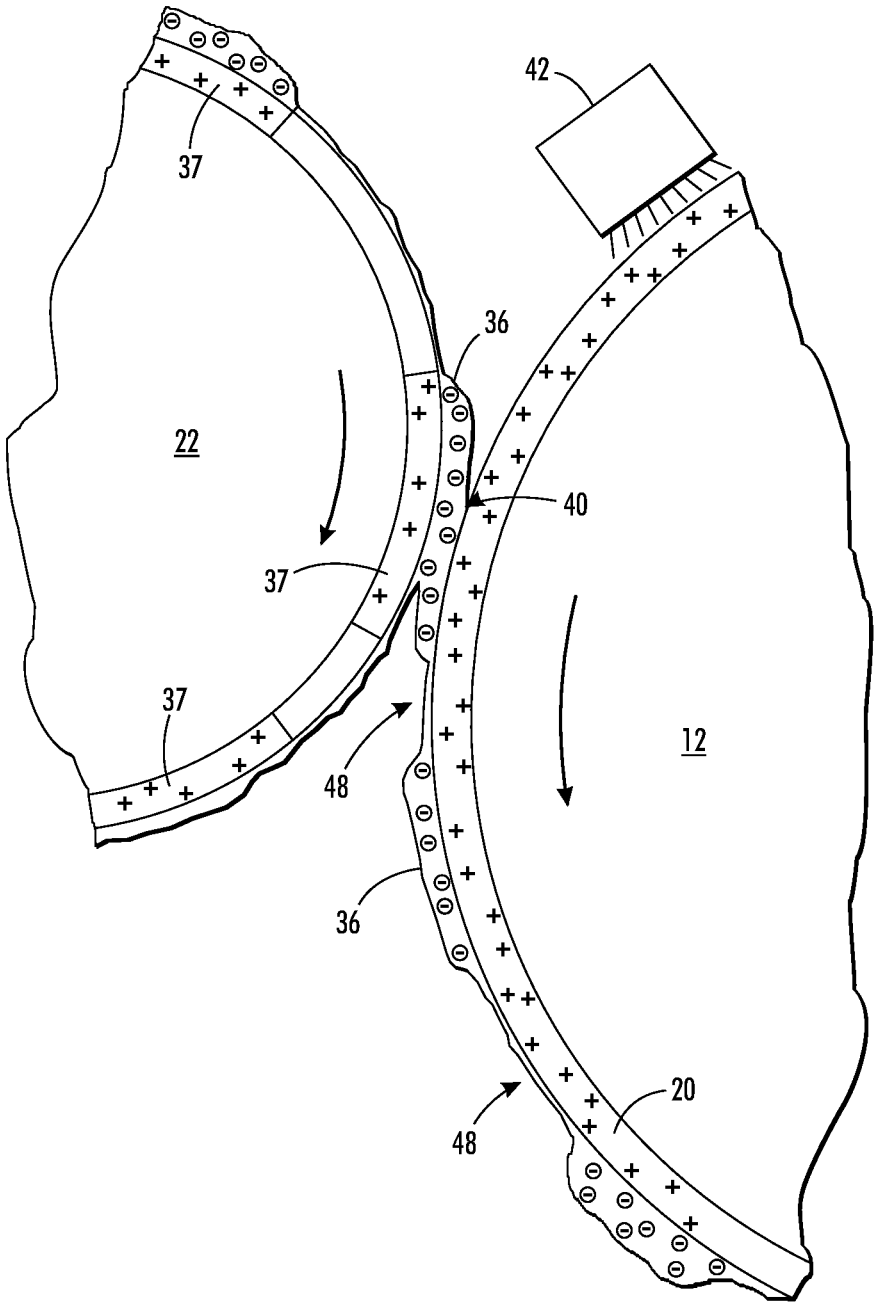
FIG. 3 is a side-view, cut-away illustration of a mechanism for transferring a dampening fluid image to the surface of an imaging member according to one embodiment of the present disclosure.

According to another embodiment of the present disclosure, illustrated in FIG. 3, charged particles in the dampening fluid are again used, this time to assist with the transfer of the dampening fluid from photoreceptor 22 to reimageable surface 20. In this embodiment, pre-charging or biasing reimageable surface 20, for example by charging device 42, may aid transfer of dampening fluid from photoreceptor 22 to reimageable surface 20. For example, if reimageable surface 20 is provided with an increased attractive charge to the dampening fluid as compared to regions 37 of photoreceptor 22, the dampening fluid will preferentially be attracted to reimageable surface 20. Due to surface tension, affinity of the dampening fluid to the surface of layer 20, and the aforementioned electrostatic attraction, the dampening fluid of regions 36 will wet the reimageable surface 20 where the two come into contact at transfer point 40. The dampening fluid will split as the photoreceptor and imaging member 12 rotate relative to one another, transferring substantially the entirety of dampening fluid regions 36 from photoreceptor 22 to reimageable surface 20. Any dampening fluid remaining on photoreceptor 22 may be removed or allowed to evaporate prior to the next cycle of charging and developing the photoreceptor. Inking regions 48 between dampening fluid regions 36 are thereby formed.

Returning to FIG. 1, according to another embodiment of the present disclosure, the viscosity of the dampening fluid may be intentionally increased, particularly on the exposed surface opposite the surface of photoreceptor 22, so as to increase its adhesion to reimageable surface 20. In addition to its role in evaporating excess residual dampening fluid, heating element 34 may also serve to partially dry dampening fluid regions 36, transforming them to a higher viscosity or even semi-solid state. The viscosity of the fluid in regions 36 is thereby increased, particularly at exposed surfaces, and accordingly regions 36 tend to selectively adhere to reimageable surface 20 at transfer point 40.

The latent image formed by regions 36 now resident on reimageable surface 20 is next inked by inking subsystem 46. Inking subsystem 46 may consist of a "keyless" system using an anilox roller to meter offset ink onto one or more forming rollers. Alternatively, inking subsystem 46 may consist of more traditional elements with a series of metering rollers that use electromechanical keys to determine the precise feed rate of the ink. The general aspects of inking subsystem 46 will depend on the application of the present disclosure, and will be well understood by one skilled in the art.

In order for ink from inking subsystem 46 to initially wet over the reimageable surface 20, the ink must have sufficiently high adhesion to reimageable surface 20 and low enough cohesive energy to split onto the exposed portions of the reimageable surface 20 (into ink receiving regions 48) and also be cohesive enough to split the dampening fluid between regions 36 or have low enough adhesion to the dampening fluid so as to separate from the dampening fluid in regions 36. Since the dampening fluid may have a relatively low viscosity, areas covered by dampening fluid naturally reject the ink because splitting naturally occurs in the dampening fluid layer that has very low dynamic cohesive energy. In areas without dampening fluid, if the cohesive force between the ink is sufficiently lower than the adhesive forces between the ink and the reimageable surface 20, the ink will split between these regions at the exit of the forming roller nip and transfer from inking system 46 to reimageable surface 20.

Therefore, according to one embodiment, the ink employed has a sufficiently low viscosity in order to promote better filling of regions 48 and better adhesion to reimageable surface 20. For example, if an otherwise known UV ink is employed, and the reimageable surface 20 is comprised of silicone, the viscosity and viscoelasticity of the ink will likely need to be modified slightly to lower its cohesion and thereby be able to wet the silicone. Adding a small percentage of low molecular weight monomer or using a lower viscosity oligomer in the ink formulation can accomplish this rheology modification. In addition, wetting and leveling agents may be added to the ink in order to further lower its surface tension in order to better wet the silicone surface.

In addition to rheological considerations, it is also important that the ink composition maintain an energetic character relative to that of the dampening fluid such that it is rejected by dampening fluid regions 36. This can be maintained by choosing offset ink resins and solvents that are, for example, hydrophobic and have non-polar chemical groups (molecules).

There are two competing results desired at this point. On the one hand, the ink must flow easily into regions 48 so as to be placed properly for subsequent image formation. On other hand, it is desirable that the ink stick together in the process of separating from dampening fluid regions 36, and ultimately it is also desirable that the ink adhere to the substrate and to itself as it is transferred out of regions 48 onto substrate 14 both to fully transfer the ink (fully emptying regions 48) and to limit bleeding of ink at the substrate. These competing results may be obtained by modifying the cohesiveness and viscosity components of the complex viscoelastic modulus of the ink while it resides over reimageable surface layer 20. Additional discussion of these considerations and materials and methods for consideration in selecting an appropriate dampening fluid and ink system are provided in copending U.S. application for letters patent Ser. No. 13/095,714, which is incorporated herein by reference.

The ink in regions 48 is next transferred to substrate 14 at transfer subsystem 50. In the embodiment illustrated in FIG. 1, this is accomplished by passing substrate 14 through nip 16 between imaging member 12 and impression roller 18. Adequate pressure is applied between imaging member 12 and impression roller 18 such that the ink within region 48 is brought into physical contact with substrate 14. Adhesion of the ink to substrate 14 and strong internal cohesion cause the ink to separate from reimageable surface 20 and adhere to substrate 14. Impression roller 18 or other elements of nip 16 may be cooled to further enhance the transfer of the inked latent image to substrate 14. Indeed, substrate 14 itself may be maintained at a relatively colder temperature than the ink on imaging member 12, or locally cooled, to assist in the ink transfer process.

Some dampening fluid may also wet substrate 14 and separate from reimageable surface 20, however, the volume of this dampening fluid will be minimal, and it will rapidly evaporate or be absorbed within the substrate. Optimal charge on surface 20 and the electrostatic interaction with the particles in the dampening fluid will reduce transfer of the dampening fluid to substrate 14.

Alternatively, it is within the scope of this disclosure that an offset roller (not shown) may first receive the ink image pattern, and thereafter transfer the ink image pattern to a substrate, as will be well understood to those familiar with offset printing. Other modes of indirect transferring of the ink pattern from imaging member 12 to substrate 14 are also contemplated by this disclosure.

Following transfer of the majority of the ink to substrate 14, any residual ink and residual dampening fluid must be removed from reimageable surface 20, preferably without scraping or wearing that surface. Most of the dampening fluid can be easily removed quickly by using an air knife 52 with sufficient airflow. However some amount of ink residue may still remain. Removal of this remaining ink may be accomplished in a variety of ways, such as by a cleaning subsystem 54 of the type disclosed in the aforementioned U.S. application for letters patent Ser. No. 13/095,714.

Figure 4:
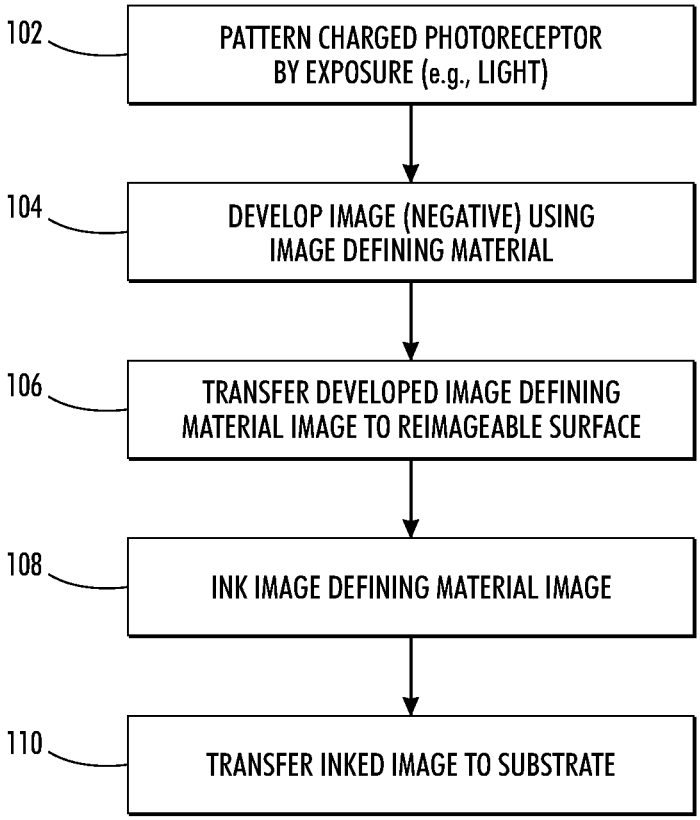
FIG. 4 is a flow diagram illustrating an embodiment of operation of a system for variable lithography for example of the type shown in FIG. 1.

Accordingly, a complete hybrid system and process is disclosed in which, with reference to FIG. 4, a charged photoreceptor is patterned at 102 and developed at 104 from dampening fluid utilizing certain aspects of a liquid electrophotography system and process, to form a latent negative of the image to be printed. The latent image of dampening fluid is transferred at 106 to an imaging member, and inked on the surface of the imaging member at 108. The inked image is then transferred to a substrate at 110 utilizing certain aspects of a variable data lithography system and process.

Figure 5:
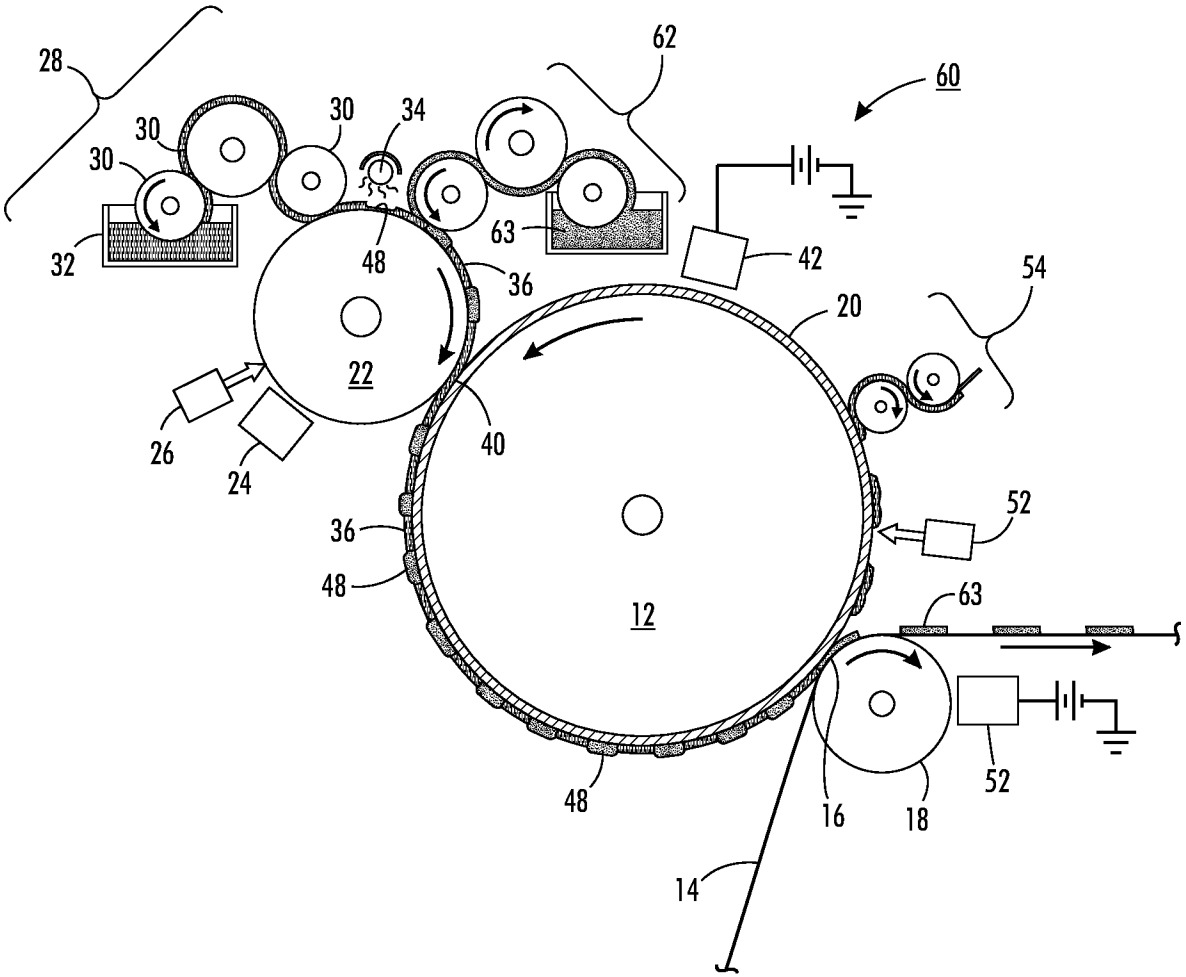
FIG. 5 is a side view of a system for variable lithography according to another embodiment of the present disclosure.

According to another embodiment of the present disclosure illustrated in FIG. 5, a latent image is also formed from dampening fluid on a photoreceptor utilizing certain aspects of a liquid electrophotography system. The latent image may be inked on the photoreceptor, and then transferred to a imaging member prior to applying the inked image to the substrate.

Many of the subsystems and mechanisms illustrated in FIG. 5 are similar to those shown and described with reference to FIG. 1. These common subsystems and mechanisms are not further described in detail here. In device 60 an inking subsystem 62 is disposed proximate photoreceptor 22. In certain embodiments, inking subsystem 62 takes the place of inking subsystem 46, disposed proximate reimageable surface 20, while in other embodiments both inking subsystems 46 and 62 may be employed. Inking subsystem 62 will be located following dampening fluid subsystem 28 in the direction of motion of photoreceptor 22. Inking subsystem 62 may also be disposed following heating mechanism 34 in the direction of motion of photoreceptor 22 when such a heating mechanism is employed.

Figure 6:
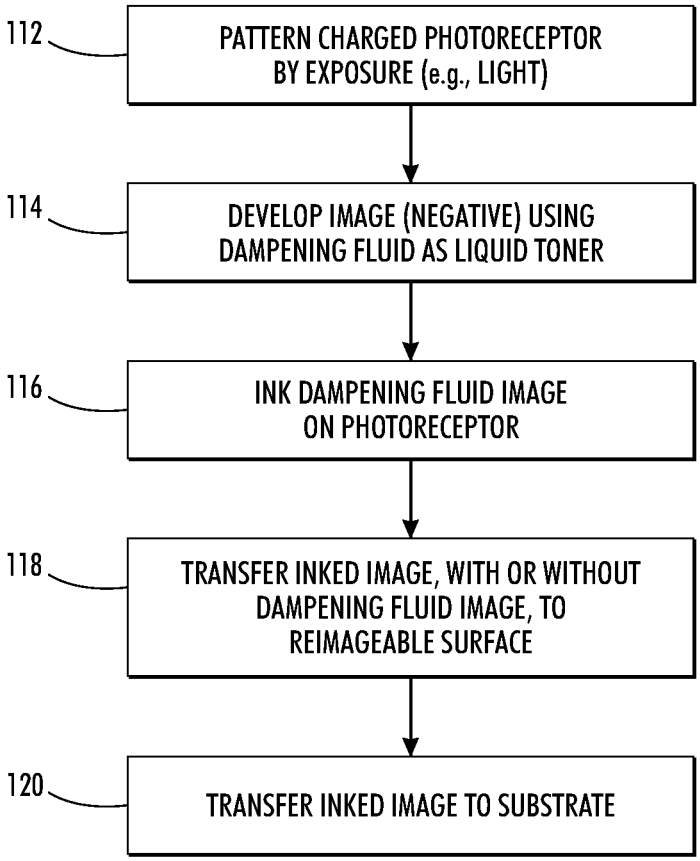
FIG. 6 is a flow diagram illustrating an embodiment of operation of a system for variable lithography for example of the type shown in FIG. 5.

With reference to FIG. 6, a charged photoreceptor is patterned at 112 and developed at 114 from dampening fluid utilizing certain aspects of a liquid electrophotography system and process. The dampening fluid image (which is a negative of the image to be printed) is inked while still resident on the surface of the photoreceptor at 116. The inked image, with or without the dampening fluid image, is transferred at 118 to an imaging member. The inked image is then transferred to a substrate at 120 utilizing certain aspects of a variable data lithography system and process.

In one embodiment, the ink definition dampening fluid may be water or a water-based composition. In certain embodiments, the ink definition dampening fluid may be sacrificial, and consumed in a print cycle, such as by evaporation or removal and disposition such as by cleaning subsystem 54. Optionally, any ink definition dampening fluid remaining on reimageable surface 20 can be removed, recycled, and reused.

It will therefore be understood that while a water-based solution is one embodiment of a dampening fluid that may be employed in the embodiments of the present disclosure, other non-aqueous dampening fluids with low surface tension, that are oleophobic, are vaporizable, decomposable, or otherwise selectively removable, etc. may be employed. One such class of fluids is the class of HydroFluoroEthers (HFE), such as the Novec brand Engineered Fluids manufactured by 3M of St. Paul, Minn. These fluids have the following beneficial properties in light of the current disclosure: (1) they leave substantially no solid residue after evaporation, which can translate into relaxed cleaning requirements and/or improved long-term stability; (2) they have a low surface energy, as required for proper wetting of the imaging member; and, (3) they are benign in terms of the environment and toxicity. Additional additives may be provided to control the electrical conductivity of the dampening fluid over the photoreceptor. Other suitable alternatives include fluorinerts and other fluids known in the art, that have all or a majority of the above properties. It is also understood that these types of fluids may not only be used in their undiluted form, but as a constituent in an aqueous non-aqueous solution or emulsion as well.

Reimageable surface 20 (FIG. 1) must facilitate the flow of ink onto its surface with uniformity and without beading or dewetting. Various materials such as silicone can be manufactured or textured to have a range of surface energies, and such energies can be tailored with additives. Reimageable surface 20, while nominally having a low value of dynamic chemical adhesion, may have a sufficient surface energy in order to promote efficient ink wetting/affinity without ink dewetting or beading. A more detailed discussion of reimageable surface 20 may be found in the aforementioned U.S. application for letters patent Ser. No. 13/095,714.

A system having a single imaging cylinder 12, without an offset or blanket cylinder, is shown and described herein. The reimageable surface 20 is made from material that is conformal to the roughness of print media via a high-pressure impression cylinder, while it maintains good tensile strength necessary for high volume printing. Traditionally, this is the role of the offset or blanket cylinder in an offset printing system. However, requiring an offset roller implies a larger system with more component maintenance and repair/replacement issues, increased production cost, and added energy consumption to maintain rotational motion of the drum (or alternatively a belt, plate or the like). Therefore, while it is contemplated by the present disclosure that an offset cylinder may be employed in a complete printing system, such need not be the case. Rather, the reimageable surface layer may instead be brought directly into contact with the substrate to affect a transfer of an ink image from the reimageable surface layer to the substrate. Component cost, repair/replacement cost, and operational energy requirements are all thereby reduced.

Figure 7:
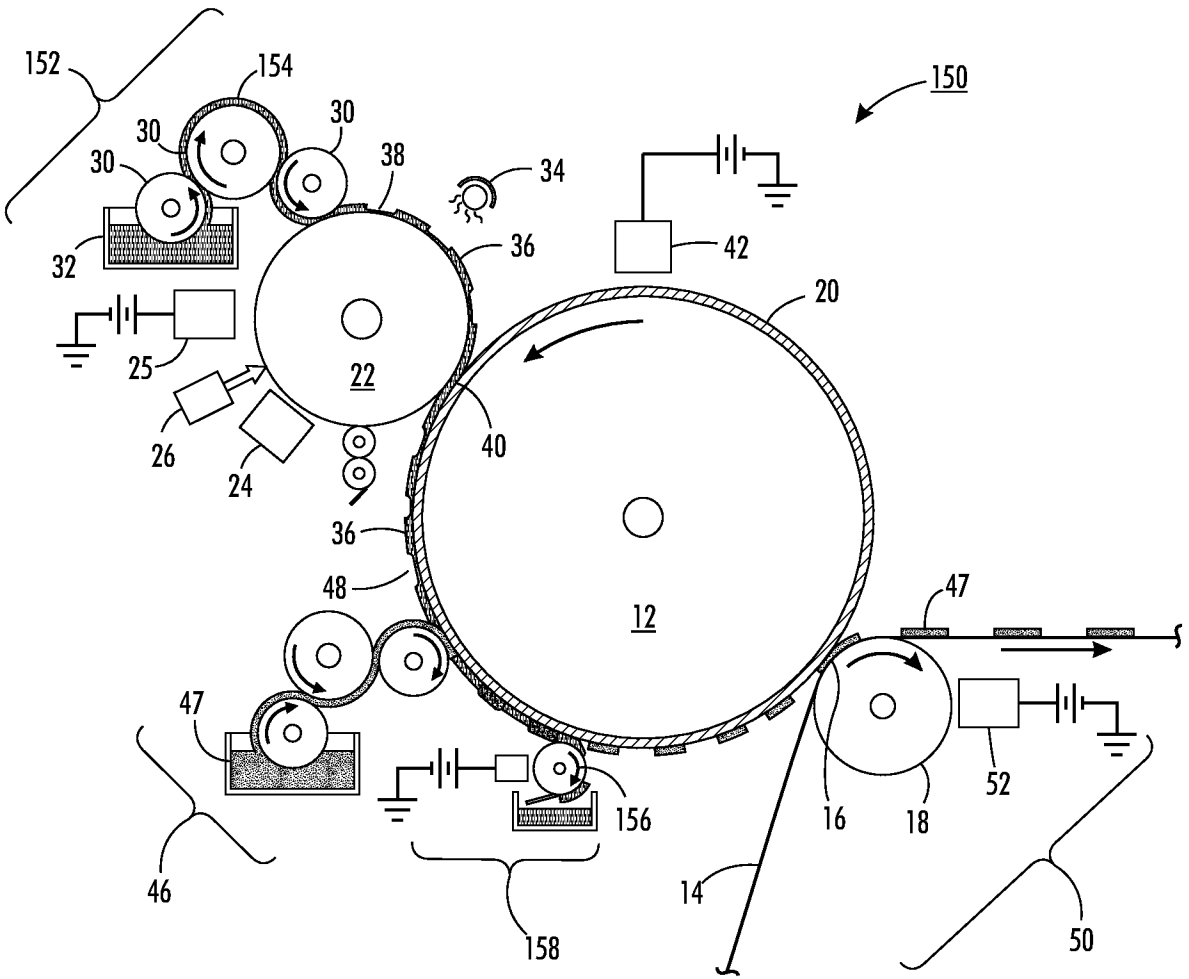
FIG. 7 is a side view of a system for variable lithography utilizing a dry toner according to one embodiment of the present disclosure.

The description above has assumed that the image defining material is a liquid dampening fluid. However, according to various embodiments of the present disclosure described following, the image defining material may be a dry material. With reference to FIG. 7, one embodiment 150 of such a dry toner system is illustrated. Many of the elements of embodiment 150 are similar to those discussed above. Therefore, elements with like reference numbers are intended to suggest that the elements are conceptually the same, subject to accommodating a dry toner as opposed to a dampening fluid pattern formation over photoreceptor 22. For example, reservoir 32 of a toner subsystem 152 in embodiment 150 contains a dry, electrostatic, ink-phobic toner 154 (for example silicone coated paramagnetic beads≤5 microns in diameter). The toner subsystem 152 applies toner 154 to the surface of photoreceptor 22 such that toner preferentially occupies regions 36 over unexposed (charged) regions of the photoreceptor, similar to the dampening fluid. Heat source 34 may heat and thereby partially fuse the toner in regions 36 as well as increase the adhesiveness of at least an outer surface thereof.

In certain embodiments, the toner material may comprise magnetic elements and a magnetic brush development subsystem. See, e.g., U.S. Pat. No. 3,998,160, U.S. Pat. No. 4,517,268, and USP publ 2009/0325098, each incorporated by reference herein. A magnetic toner material and magnetic brush development system form one of many usable electrophotographic dry toner developer systems. The developer primarily takes toner from a source or sump and distributes a uniform thin layer on the photoreceptor in the regions of the latent charge image. According to one example, the toner adheres to the charged regions which have not been illuminated. The magnetic brush developer uses a collection of relatively large magnetizable beads mixed with the toner. In a rotating magnetic field the beads form a brush which picks up the toner from a sump, helps to tribocharge the toner particles through frictional forces, and gently deposits the toner on the photoreceptor as the brush passes over the moving photoreceptor surface.

Magnetic particles (either paramagnetic or having a permanent magnetic moment) are used in magnetic inks and toner for magnetic ink character recognition (MICR) applications. Here similar particles are used with the resultant property that they can be extracted from the surface of the ink and recycled using a strong magnetic field. The magnetic particles can be made of iron oxides or similar materials and, in liquid carriers, the particles can be sub-micron in diameter and transparent in the visible.

Figure 8:
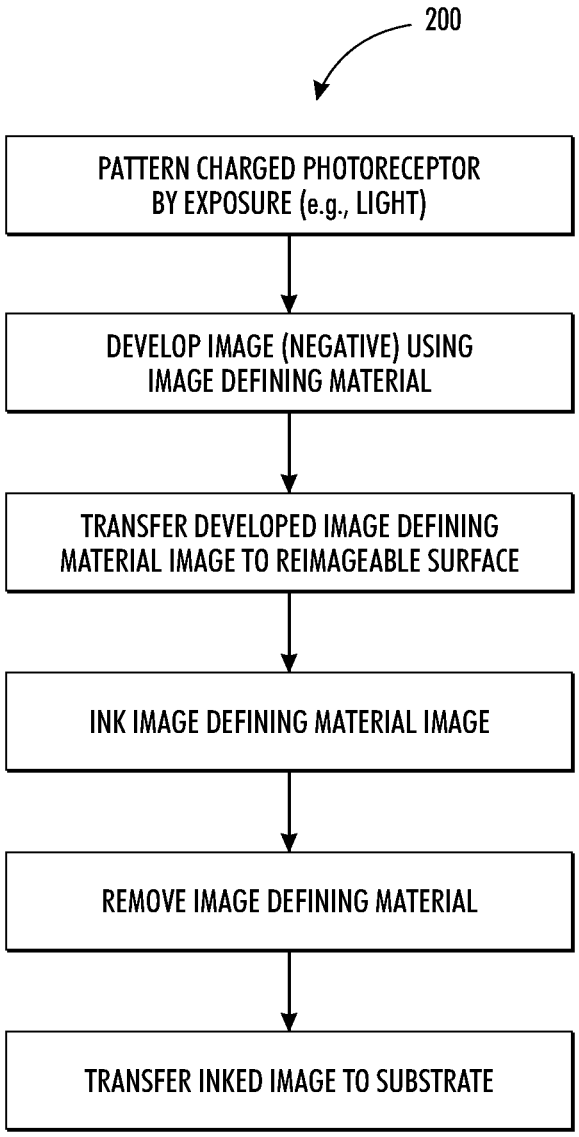
FIG. 8 is a flow diagram illustrating another embodiment of operation of a system for variable lithography for example of the type shown in FIG. 7.

Toner in regions 36 is transferred from the surface of photoreceptor 22 to reimageable surface 20, with or without electrostatic assistance. A negative pattern (relative to the intended ink pattern) is thereby formed on reimageable surface 20. Ink is applied by inking subsystem 46 over the reimageable surface 20 and the pattern of toner regions 36. Since toner 154 is substantially ink-phobic, ink adheres to regions of exposed reimageable surface 20 and is rejected over regions 36. Ink therefore preferentially deposits into the interstices between toner regions 36. The ink may be transferred to substrate 15 at nip 16, with cleaning of toner from reimageable surface 20 as previously discussed, or as shown in FIG. 7, toner in regions 36 may be removed, for example by an electrostatic or magnetic attraction to a cleaning member 156 of a cleaning subsystem 158, prior to application of ink to substrate 14. A corresponding method 200 is shown in FIG. 8. Optionally, the toner removed by cleaning subsystem 158 may be recycled and reused for cost efficiency, environmental concerns, and so on.

In either the liquid or dry embodiments, optionally, impression roller 18 may be provided with a charge opposite that of the charge on particles comprising the image forming material. This results in preferential rejection of the particles, and hence the image defining material, over substrate 14, with substantially only the ink transferring from reimageable surface 20 to substrate 14.

Figure 9:
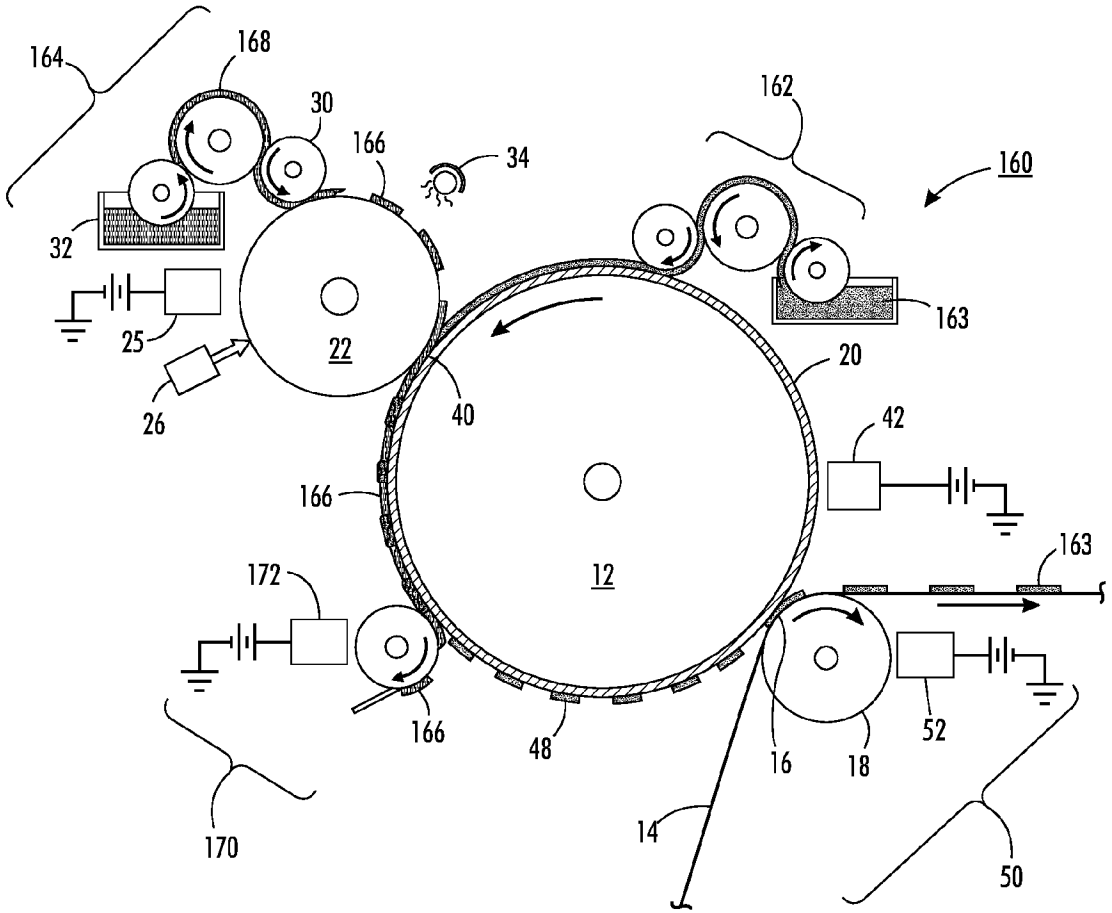
FIG. 9 is a side view of a system for variable lithography utilizing a dry toner according to another embodiment of the present disclosure.

In still another embodiment 160 illustrated in FIG. 9, an inking subsystem 162 is disposed prior to a toner subsystem 164 in the direction of rotation of imaging member 12. Inking subsystem 162 provides a uniform coating of ink over reimageable surface 20. Toner subsystem 164 forms a pattern of regions 166 of toner 168 on the surface of photoreceptor 22 as previously described. However, in the present embodiment toner 166 is strongly attractive to the ink (ink-philic). The regions 166 of toner are then transferred over the ink on reimageable surface 20 such that it sits atop of or diffuses into regions of the ink. The placement of regions 166 again corresponds to regions that will not be printed with ink in the final image applied to substrate 14 (negative image).

Figure 10:
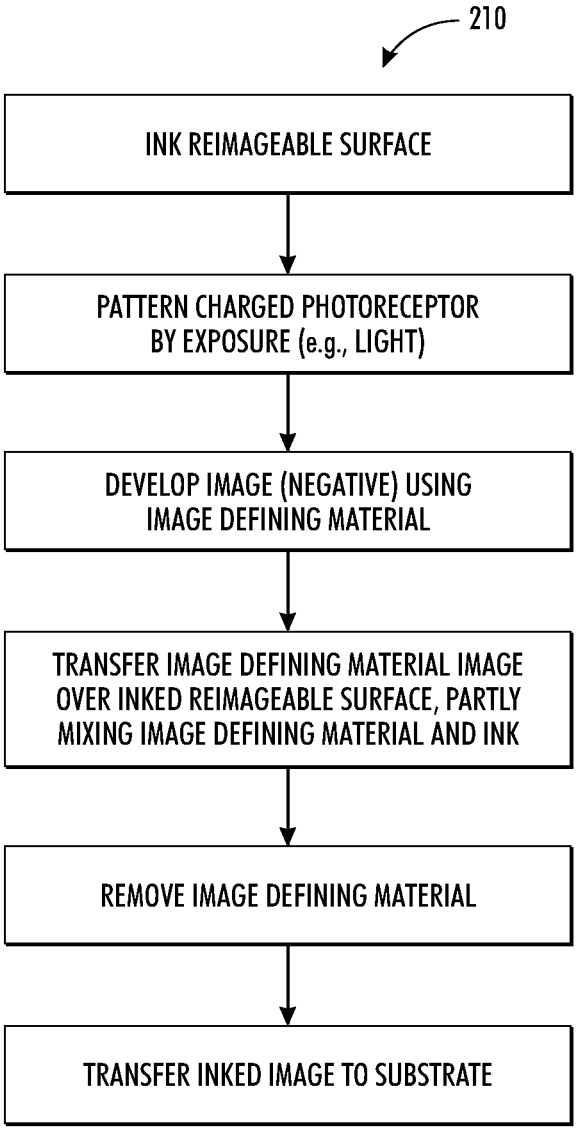
FIG. 10 is a flow diagram illustrating a further embodiment of operation of a system for variable lithography for example of the type shown in FIG. 9.

A cleaning subsystem 170 is disposed following the toner subsystem such that the toner in regions 166 are removed from reimageable surface 20. The compositions of toner 168 and reimageable surface 20 are such that toner 168 easily releases from reimageable surface 20, particularly as compared to the ink. Binding energy of the toner to reimageable surface 20 may be reduced and/or binding energy of the toner to elements of cleaning subsystem 170 may be increased by electrostatic and/or magnetic control in the region of cleaning subsystem 170. In the process of removing toner in regions 166, the portion of ink under or within which the toner in regions 166 were deposited is removed together with the toner. This may be based on a physical, chemical, or electrostatic attraction between the ink and toner. The result is that following cleaning subsystem 170 and before nip 16 in the direction of rotation of imaging member 12 only ink remains on reimageable surface. The ink is in the pattern of the final image to be applied to substrate 14, and is transferred thereto at nip 16. A corresponding method 210 is shown in FIG. 10.

Figure 11:
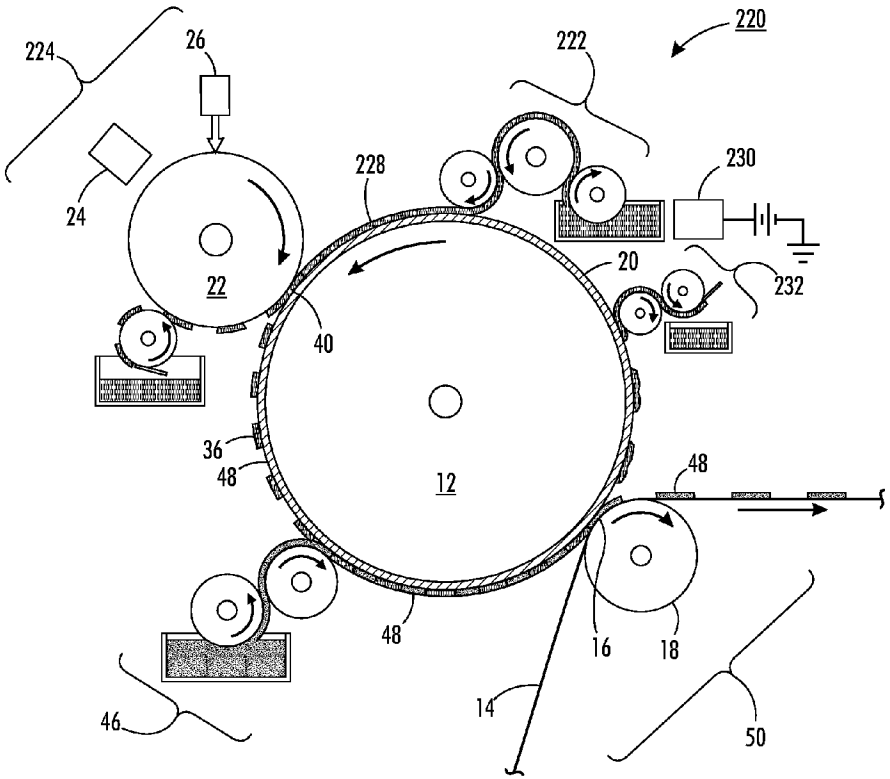
FIG. 11 is a side view of a system for variable lithography utilizing extraction of an image defining material, according to another embodiment of the present disclosure.
Figure 12:
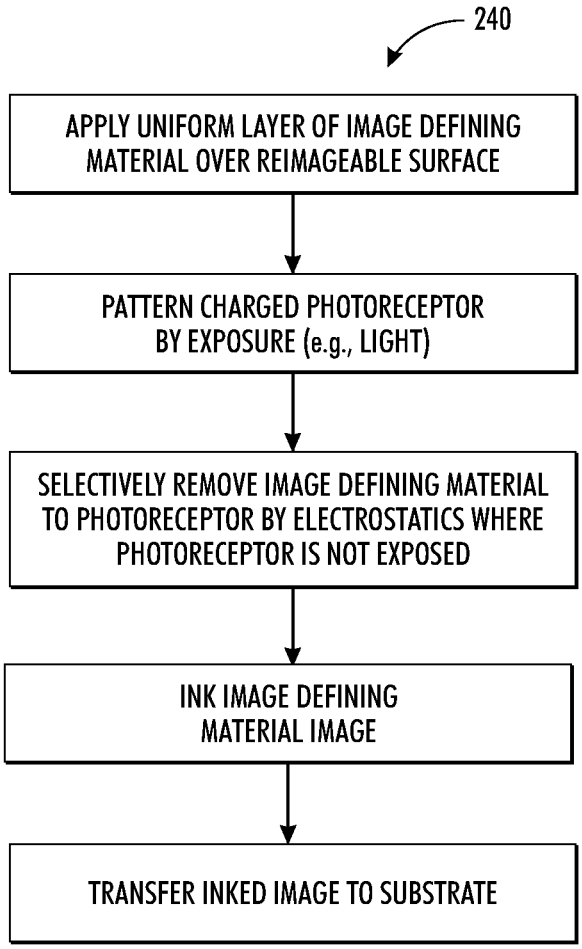
FIG. 12 is a flow diagram illustrating a further embodiment of operation of a system for variable lithography for example of the type shown in FIG. 11.

In still another embodiment 220, as illustrated in FIG. 11, a dampening fluid subsystem 222 is disposed prior to a patterning subsystem 224 in the direction of rotation of imaging member 12. Dampening fluid subsystem 222 provides a uniform layer 228 of dampening fluid over reimageable surface 20. Patterning subsystem 224 forms a latent charge pattern on the surface of photoreceptor 22 by selectively exposing regions thereof to light from source 26. The latent charge pattern corresponds to a negative of the ink image that ultimately is to be transferred to substrate 14. In the present embodiment, dampening fluid is not formed over photoreceptor 22 as previously described. Rather, as photoreceptor 22 is proximate or comes into contact with dampening fluid layer 228, it extracts regions therefrom corresponding to the charge pattern on photoreceptor 22. This extraction may be as a consequence of, or enhanced by, a charge applied to particles within the dampening fluid by a charge subsystem 230, such a charge being of opposite polarity to a charge on photoreceptor 22 in regions not exposed by light source 26. The patterned reimageable surface 20 may then be inked by an inking subsystem 46, as previously described. The ink image may then be transferred to substrate 14, also as previously discussed. A portion of the dampening fluid will have evaporated prior to reaching transfer nip 16. However, any dampening fluid remaining thereafter may be removed by a cleaning subsystem 232, and potentially recycled for reuse. A corresponding method 240 is shown in FIG. 12.

It should be understood that when a first layer is referred to as being "on" or "over" a second layer or substrate, it can be directly on the second layer or substrate, or on an intervening layer or layers may be between the first layer and second layer or substrate. Further, when a first layer is referred to as being "on" or "over" a second layer or substrate, the first layer may cover the entire second layer or substrate or a portion of the second layer or substrate.

The realization and production of physical devices and their operation are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A variable data lithography system, comprising:

a photoreceptor;

a charging subsystem for applying a first electrostatic charge to said photoreceptor;

an exposure subsystem disposed for selective exposure of said photoreceptor to thereby form an exposure pattern from regions that are exposed and unexposed by said exposure subsystem on a surface of said photoreceptor, said exposure enabling altering the electrostatic charge on said photoreceptor to thereby define regions of said photoreceptor having a first electrostatic charge state and a second electrostatic charge state;

an image defining material subsystem disposed proximate said photoreceptor for selectively applying an image defining material substantially over regions of said photoreceptor having said first electrostatic charge state and not over regions having said second electrostatic charge state to thereby form an image defining material image on a surface of said photoreceptor corresponding to said exposure pattern;

an imaging member having a reimageable surface formed thereover, disposed proximate said photoreceptor such that said image defining material selectively applied over said photoreceptor is transferred to said reimageable surface, forming regions of image defining material separated by regions of no image defining material on said reimageable surface, and thereby transferring said image defining material image from said photoreceptor to said reimageable surface;

an inking subsystem, disposed prior to said photoreceptor in a direction of rotation of said imaging member, for applying an ink layer substantially uniformly over said reimageable surface;

said photoreceptor disposed relative to said imaging member such that said image defining material image may be transferred from said photoreceptor to said reimageable surface over said imaging member, and further such that image defining material comprising said image defining material image at least in part mix with ink in said ink layer;

a cleaning subsystem disposed proximate said imaging member such that said image defining material may be removed from over said imaging member, said cleaning subsystem further configured such that said image defining material removes with it at least a portion of said ink with which said image defining material has mixed, and leaving on said reimageable surface at least a portion of said ink which has not mixed with said image defining material, to thereby form an inked image over said reimageable surface; and an image transfer subsystem for transferring the ink forming said inked image to a substrate to thereby transfer said inked image from said reimageable surface to said substrate.

2. The variable data lithography system of claim 1, wherein said image defining material comprises a particulate material, said particulate material capable of retaining an electrostatic charge and of intermixing into said ink upon transfer from said photoreceptor to said imaging member, and said cleaning subsystem is configured to remove said particulate material together with a portion of said ink by way of said electrostatic charge.

3. The variable data lithography system of claim 1, wherein said image defining material comprises a particulate material, said particulate material capable of being magnetized and of intermixing into said ink upon transfer from said photoreceptor to said imaging member, and said cleaning subsystem is configured to remove said particulate material together with a portion of said ink by way of magnetic attraction of said particulate material.

* * * * *